United States Patent [19]

Eilertsen et al.

[11] Patent Number: 4,507,636

[45] Date of Patent: Mar. 26, 1985

[54] NEUTRAL POINT PLATE OF THREE-PHASE TRANSFORMER FOR LARGE SECONDARY CURRENTS

[75] Inventors: Odd J. Eilertsen; Ottar H. Svensen, both of Sarpsborg, Norway

[73] Assignee: National Industri A/S, Drammen, Norway

[21] Appl. No.: 582,927

[22] Filed: Feb. 23, 1984

[30] Foreign Application Priority Data

Sep. 23, 1983 [NO] Norway ..... 833430

[51] Int. Cl.[3] ..... H01F 33/00; H01F 15/04

[52] U.S. Cl. ..... 336/12; 336/84 C; 373/102

[58] Field of Search ..... 373/102, 103; 323/361; 307/91; 336/5, 10, 12, 84 C, 84 R, 90, 192, 107

[56] References Cited

U.S. PATENT DOCUMENTS

| | | | |
|---|---|---|---|
| 3,436,703 | 4/1969 | Schlawin | 336/12 |
| 3,465,272 | 9/1969 | Bach | 336/12 |
| 4,174,509 | 11/1979 | Bach et al. | 336/12 |
| 4,375,627 | 3/1983 | Hansen et al. | 336/5 |

FOREIGN PATENT DOCUMENTS 2736092 8/1977 Fed. Rep. of Germany .

*Primary Examiner*—Thomas J. Kozma

*Attorney, Agent, or Firm*—Pearne, Gordon, Sessions, McCoy, Granger & Tilberry

[57] ABSTRACT

The present invention relates to a structure of neutral point of multiphase transformers for large secondary currents. Such multiple phase transformers, usually three phase transformers, are used for example for the operations of arc furnaces, and the secondary current of the transformer may amount to several thousand ampere. The neutral point is made as a plate (24) of material with good electric conductivity and is located within the transformer tank (27). Between the neutral point plate (24) and the tank wall (27) there is located a plate (25) of a material with good conductivity and serving as a screen for reducing losses in the tank wall (screen plate). The transformer is star connected on the secondary side. Each phase of the secondary winding consists of several windings connected in parallel, and the tappings are passed as parallel conductors onto the neutral point plate (24). The neutral point tappings (22) are connected to the neutral point plates (24), whereas the phase tappings are passed through openings both in the neutral point plate (24) and the screen plate (25) onto insulating ducts (26) in the tank wall (27).

4 Claims, 3 Drawing Figures

NEUTRAL POINT PLATE OF THREE-PHASE TRANSFORMER FOR LARGE SECONDARY CURRENTS

BACKGROUND OF THE INVENTION

1. Field of the Art

An arc furnace transformer must be designed for very large secondary currents. For large arc furnaces the currents may amount to 80 to 100 thousand ampere.

2. Prior Art Statement

Traditionally arc furnace transformers have been designed with open secondary phases and the delta connection of the phases has been located outside the transformer tank. In that manner current compensation has been obtained by passing the forward and return current conductors close to each other, so that the magnetic fields become small. This has made it possible to cope with the current losses and heat problems. However, such outside delta connection becomes very bulky because of the large current intensity and poor cooling conditions. Short insulating distances in air combined with dust deposits likewise involve a permanent danger of flashover between the conductors.

In recent years it has become more usual to place the delta connections within the transformer tank, where cooling and insulating conditions are ideal. On the other hand this involves the necessity of passing heavy currents without compensation through the wall or cover of the tank, which in turn requires expedients for preventing high eddy current losses and heat problems. Therefore, in many cases there has been used a separate duct panel of insulating material or of non-magnetic material with good electric conductivity. This panel has been attached in a corresponding opening in the tank wall by means of fastening elements. A main weak point of such a structure is the sealing between tank and panel.

In operation it will always be a problem to obtain even load in an arc furnace, since the conditions in the furnace are constantly changing. It has therefore been desirable to make it possible to control the electrode voltages (phase voltages) individually and independently of each other. In order to make this technically possible, secondary phases of the furnace transformer must be star connected. Such connection can also be effected within the transformer by means of bars like in the case of a delta connection. But even in this case the relatively complicated bar system involves the same risk of high eddy current losses and heat problems.

According to the present patent application these difficulties are avoided by a transformer designed in accordance with the main claim of the application.

The neutral point plate with screen plate as taught by the present invention replaces the complicated part of the bar system for connecting the secondary phases of an internal star system. The screen plate between the neutral point plate and the tank wall will effectively prevent induced currents and reduce temperature problems in the wall of the tank.

The advantages of this invention consist in that the neutral point plate as compared with a conventional bar system makes the connections between the secondary windings and the wall ducts simpler and shorter. This results in lower short circuit reactance and loss. The screen plate chokes efficiently the magnetic field from the neutral point plate, so that the tank wall in its entirety can be made as a welded structure. A duct panel of special design will therefore not be necessary. This avoids the leakage problems associated with a duct panel with flanges.

BRIEF DESCRIPTION OF THE DRAWINGS

The invention will now be described more detailed with reference to the diagrammatic drawings which illustrate embodiments.

DESCRIPTON OF A PREFERRED EMBODIMENT

Figure 1:
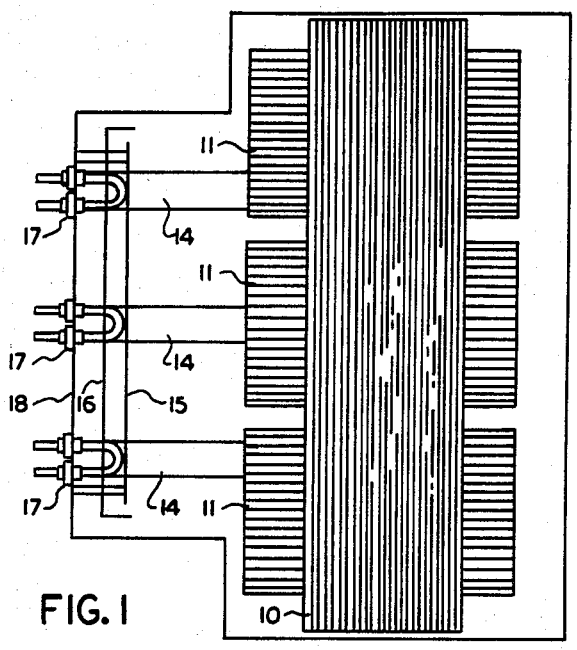
FIG. 1 is a top view of a transformer according to the invention.

The transformer shown in FIG. 1 is a three phase transformer designed for delivering large secondary currents. The transformer may be of shell type or core type. The transformer is designed with an iron core 10, and windings 11 are mounted on the core in accordance with usual methods.

The low tension or secondary winding is star connected. The output conductors of the secondary winding are passing large currents and made in the form of bars 14. They are passed to the neutral point plate 15. Here the neutral point tapping of the secondary windings is connected to the neutral point plate. The phase tappings are passed through openings both in the neutral point plate 15 and in the screen plate 16 to high current insulating ducts 17 extending through the wall 18 of the transformer tank. The core with windings as well as output bars with neutral point plate and screen plate are placed in a transformer tank 18 filled with transformer oil or other insulating liquid. This insulating liquid also serves as a cooling medium.

Figure 2:
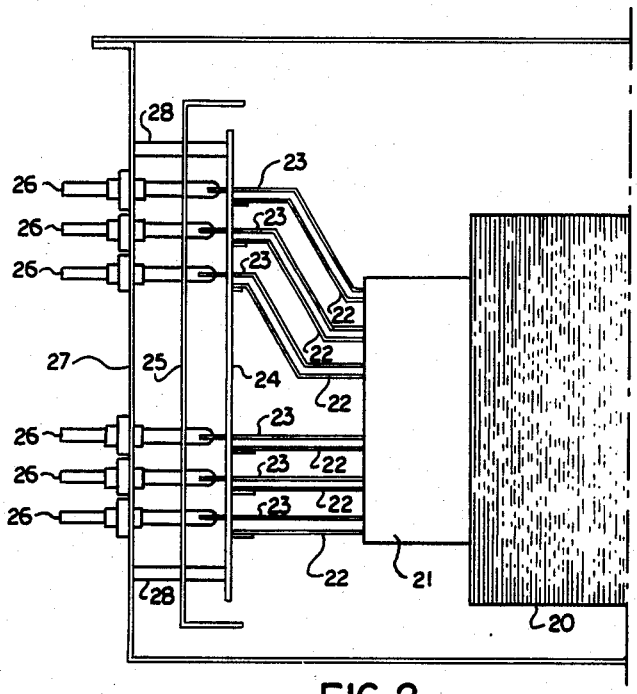
FIG. 2 is a view in longitudinal vertical section of part of the transformer and illustrates important features of the invention. The figure shows winding tappings with insulating ducts as well as neutral point plate and screen plate.

FIG. 2 is a sectional view of part of the transformer with winding tappings and insulating ducts as well as the neutral point plate and the screen plate.

20 designates the transformer core and 21 the windings.

Each phase of the secondary winding usually consists of one or more windings connected in parallel. The tap connectors from these windings, designated 22 and 23, are passing large currents and are made in the shape of bars. Normally the tap conductors will be branched to several windings, but this has not been shown in the drawing. The bars are passed as parallel conductors to the neutral point plate 24. Therefore, the compensated course of the conductors is conserved onto the connection point of the neutral point tappings. This is an important advantage over previous structures in which the neutral point has been constituted by interconnected bars. This could involve long uncompensated bar courses causing great additional losses in the transformer, as well as a great short-circuit reactance.

The neutral point tappings 22 are connected to the neutral point plate 24. The neutral point 24 is mounted electrically insulated from the transformer tank by means of insulating spacers 28. It is preferably placed directly opposite the tappings on the secondary windings, so as to minimize their length. The neutral point plate extends throughout the area in which the tappings are located. For that reason it will simplify the interconnection of the secondary phases. It involves great flexibility in location and connection of the phase tappings.

It is easier to obtain symmetric conductor forces and shorter conductors on to a plate extending throughout the area within which the tappings are placed, than by previous transformer designs with interconnected bars. With short conductors or bars the transformer will have low short-circuit reactance, and additional losses are reduced.

For this transformer type which may be used for UHP="ultra high power" operation of melting furnaces, it is an important advantage that the short-circuit reactance is low.

The phase tappings 23 are passed through openings both in the neutral point plate 24 and in the screen plate 25 and connected to heavy current insulating ducts 26. The high current insulating ducts are usually hollow and designed for cooling with liquid. The ducts 26 are passed through the wall 27 of the transformer tank in the usual manner.

The transformer tank wall where the heavy current insulating ducts are placed, is made of unmagnetic material, usually austenitic steel. The remainder of the transformer tank is made of structural steel. The entire transformer tank, i.e. bottom and lateral faces, may therefore in its entirety be made as a welded structure. With the star point made in the form of a neutral point plate and mounted in the transformer tank it is possible to dispense with previously known expedients such as mounting a cut out section or part of the transformer tank wall insulated from the remainder of the transformer tank. In practice it has been very difficult to achieve a satisfactory sealing of such structures and these would be considerably more expensive in pro- duction.

The screen plate 25 is placed between the neutral point plate 24 and the tank wall 27. It is mounted electrically insulated from the transformer tank by means of insulating spacers 28. It consists of unmagnetic material with good electric conductivity. The object of the screen plate is to reduce the field in the transformer tank wall. As an ideal it is desired to place it so near to the tank wall as possible, but practical design of the transformer may prevent this. The screen plate will preferably cover the entire tank wall within the area in which the insulating ducts are placed. It may also, if desired, extend over part of the adjacent container walls and be bent around the lateral edges of the neutral point plate so as to cope with possible edge phenomenons. In order to be efficient the screen plate must be at least as thick as the penetration depth of the magnetic field at net frequency in the material used.

Figure 3:
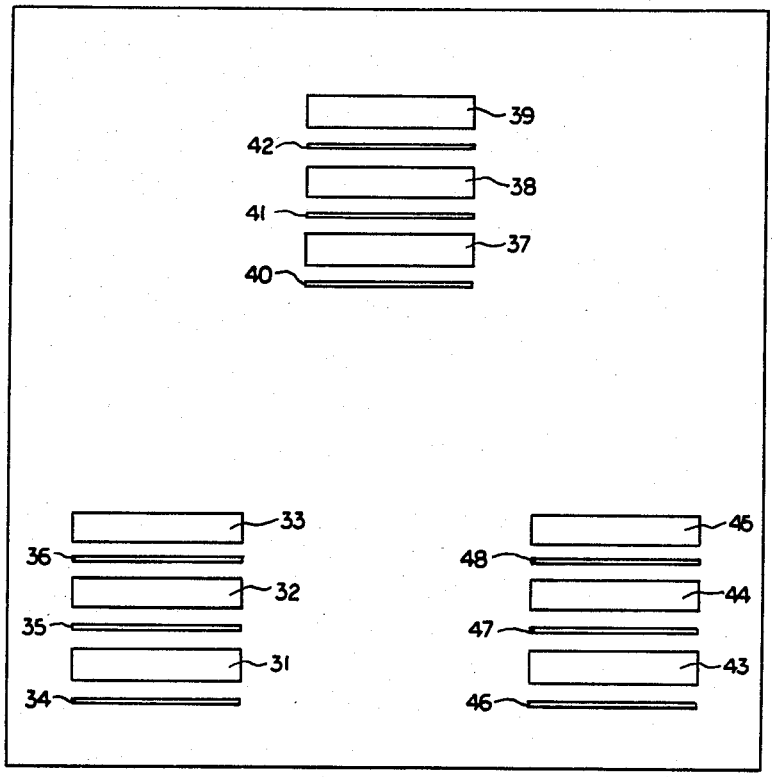
FIG. 3 shows in elevation an embodiment of a neutral point plate.

FIG. 3 shows an embodiment of a neutral point plate in elevation.

The tappings from the secondary windings of an arc furnace transformer are usually "triangulized" in order as far as possible to obtain equal reactance between the phases. That means that the points of gravity of the taps from the individual phases are placed in the corners of an equilateral triangle.

The spacing of the tappings depends on the power and physical dimensions of the transformer and possible demands of the client.

The phase tappings are passed through openings in the neutral point plate, whereas the neutral points are connected to the plate. In FIG. 3 the phase tappings from phase u have been passed through the openings 31, 32 and 33, whereas the neutral point tappings are shown connected to the plate in the connection points 34, 35 and 36. In the same way the tappings from phase v are passed through the openings 37, 38 and 39 and those from phase w through the openings 43, 44 and 45. The neutral point tappings are correspondingly connected to the plate in the connection points 40, 41 and 42 for phase v and 46, 47 and 48 for phase w.

The neutral point plate consists of a material with good electric conductivity, preferably copper or aluminum. It extends throughout the area where the secondary tappings of the transformer are placed. Shape and extension will follow the dimensions of the transformer. In FIG. 3 it has been shown with square shape, but even other shapes may be used, for example oblong rectangular or triangular.

The neutral point plate is placed inside the transformer tank and is cooled on both sides. It will extend throughout a large area relative to previous neutral points constituted by bars and hence the cooling conditions are better.

If desired the neutral point plate may be shaped with ribs to increase the cooled area. It may also be reinforced with bars affording a larger cross section throughout the areas in which the current load is greatest.

What we claim is:

1. Three phase transformer for large secondary currents, for example arc furnace transformer, the secondary winding of which is star connected, characterized in that the neutral point of the secondary winding is constituted by a neutral point plate screened against the transformer tank wall by a screen plate, and to which the neutral point tappings of the secondary winding are connected, and that the phase tappings of the secondary winding are passed through both neutral point plate and screen plate and connected to heavy current insulating ducts extending through the transformer tank wall.

2. Transformer as claimed in claim 1, characterized in that the neutral point plate extends throughout the area in which the secondary windings are located.

3. Transformer as claimed in claim 1, characterized in that the screen plate is placed between the neutral point plate and the transformer tank wall and at least extends throughout the area occupied by the neutral point plate.

4. Transformer as claimed in claim 2, characterized in that the screen plate is placed between the neutral point plate and the transformer tank wall and at least extends throughout the area occupied by the neutral point plate.

* * * * *